US009879549B2

(12) United States Patent
Dezouche

(10) Patent No.: US 9,879,549 B2
(45) Date of Patent: Jan. 30, 2018

(54) AIRCRAFT ENGINE ANNULAR SHROUD COMPRISING AN OPENING FOR THE INSERTION OF BLADES

(75) Inventor: Laurent Gilles Dezouche, Le Coudray Montceau (FR)

(73) Assignee: SNECMA, Paris (FR)

( * ) Notice: Subject to any disclaimer, the term of this patent is extended or adjusted under 35 U.S.C. 154(b) by 1016 days.

(21) Appl. No.: 14/112,071

(22) PCT Filed: May 3, 2012

(86) PCT No.: PCT/FR2012/050980
§ 371 (c)(1),
(2), (4) Date: Oct. 16, 2013

(87) PCT Pub. No.: WO2012/153037
PCT Pub. Date: Nov. 15, 2012

(65) Prior Publication Data

US 2014/0056711 A1 Feb. 27, 2014

(30) Foreign Application Priority Data

May 9, 2011 (FR) ..... 11 53970

(51) Int. Cl.
*F01D 5/22* (2006.01)
*F01D 9/04* (2006.01)
(Continued)

(52) U.S. Cl.
CPC ..... *F01D 5/225* (2013.01); *F01D 9/042* (2013.01); *F01D 25/246* (2013.01);
(Continued)

(58) Field of Classification Search
CPC ..... F01D 5/225; F01D 5/303; F01D 5/3038; F01D 9/042; F01D 25/246; F04D 29/542;
(Continued)

(56) References Cited

U.S. PATENT DOCUMENTS 1,123,527 A * 1/1915 Hanzik ..... F01D 5/225 416/191
3,923,420 A * 12/1975 Chifos ..... F01D 5/3038 416/190
(Continued)

FOREIGN PATENT DOCUMENTS

EP 1 104 836 6/2001
EP 1 308 630 5/2003
(Continued)

OTHER PUBLICATIONS

International Search Report issued for International Application No. PCT/FR2012/050980, dated Jun. 27, 2012.
(Continued)

*Primary Examiner* — Dwayne J White
*Assistant Examiner* — Adam W Brown
(74) *Attorney, Agent, or Firm* — Pillsbury Winthrop Shaw Pittman LLP

(57) ABSTRACT

An aircraft engine annular shroud includes, on its internal surface, a peripheral annular groove able to accept a plurality of blade roots; an insertion opening for inserting the blade roots into the annular groove; and a closure device for closing off the insertion opening.

12 Claims, 6 Drawing Sheets

(51) Int. Cl.
*F01D 25/24* (2006.01)
*F04D 29/54* (2006.01)
*F04D 29/64* (2006.01)

(52) U.S. Cl.
CPC ..... *F04D 29/542* (2013.01); *F04D 29/644* (2013.01); *F05D 2240/40* (2013.01); *Y10T 29/4932* (2015.01)

(58) Field of Classification Search
CPC . F04D 29/644; Y10T 29/4932; F05D 2240/40
See application file for complete search history.

(56) References Cited

U.S. PATENT DOCUMENTS 4,155,680 A * 5/1979 Linko, III ..... F02C 6/08 415/115
4,702,673 A * 10/1987 Hansen ..... F01D 5/3046 29/447
5,350,276 A * 9/1994 Gros ..... F01D 25/24 415/168.4
5,846,050 A 12/1998 Schilling
6,152,698 A * 11/2000 Gregg ..... F01D 5/3038 29/407.05
6,296,443 B1 * 10/2001 Newman ..... F01D 9/042 415/189
6,890,151 B2 * 5/2005 Bertrand ..... F01D 9/042 415/209.2
6,893,224 B2 * 5/2005 Murphy ..... F01D 5/005 416/220 R
2006/0216152 A1 9/2006 Golinkin et al.
2011/0008171 A1 * 1/2011 Tsumura ..... F01D 5/3038 416/218

FOREIGN PATENT DOCUMENTS

GB 536161 A 5/1941
WO WO 2011/018413 2/2011

OTHER PUBLICATIONS

Examination Report as issued in United Kingdom Application No. GB1319800.7, dated Jul. 13, 2017.

* cited by examiner

AIRCRAFT ENGINE ANNULAR SHROUD COMPRISING AN OPENING FOR THE INSERTION OF BLADES

CROSS-REFERENCE TO RELATED APPLICATIONS

This is the U.S. National Stage of PCT/FR2012/050980, filed May 3, 2012, which in turn claims priority to French Patent Application No. 1153970, filed May 9, 2011, the entire contents of all applications are incorporated herein by reference in their entireties.

TECHNIQUE OF THE INVENTION

The present invention relates to an annular shroud comprising an opening for the insertion of blades. The technical field of the invention is, generally speaking, that of aircraft engines and, more particularly, that of downstream guide vanes comprising shrouds.

TECHNOLOGICAL BACKGROUND OF THE INVENTION

An aircraft engine comprises a series of compressors. In order for compression to be optimal, the air entering into said compressors has to be oriented. The parts serving to orient the air are downstream guide vanes. As represented in FIG. 1, a downstream guide vane 10 comprises an internal shroud 11, an external shroud 12 or casing shroud, as well as a plurality of blades 13. Each blade 13 comprises an external root 14 and an internal root 15. Conventionally, the external root 14 of a blade 13 is fixed by welding in the external shroud, and the internal root 15 is maintained in the internal shroud 11 by moulding of RTV silicone.

Such an assembly is not however viable at high temperatures, the RTV silicone then degrading rapidly. There are thus risks of uncoupling of the blades 13 with the internal shroud 11.

To overcome such a drawback, another attachment system of blades, represented in FIGS. 2 and 3, has been proposed. The system comprises in particular a first external half-shroud 20, a second external half-shroud, an upstream internal shroud 30, a downstream internal shroud 31, and a plurality of blades 23. Half-shroud is taken to mean a shroud having the shape of a half-ring. Each blade 23 comprises an external root 24 and an internal root 25. The first external half-shroud 20 comprises a peripheral annular groove 21 forming a guiding rail for the external roots 24 of the blades 23. The external root 24 of each blade 23 is able to be inserted into the annular groove 21 via an end 22 of the first external half-shroud 20. Each external root 24 is then positioned by displacement in the annular groove 21. Similarly, the second external half-shroud comprises a peripheral annular groove able to accept external roots of blades. The external roots of blades are inserted into the grooves at the level of the ends of the external half-shrouds.

After insertion of a certain number of blades 23 into the two external half-shrouds, the first external half-shroud 20 and the second external half-shroud are assembled by means of flanges, not represented. The blades 23 are then maintained blocked in the external half-shrouds. The upstream internal shroud 30 and the downstream internal shroud 31 are then assembled together to maintain the internal roots 25 of the blades 23 by a system of hooks and screws, known to those skilled in the art.

This attachment system does not enable the use of annular external shrouds, in other words external shrouds forming a complete closed ring, due to the system of inserting the blades 23 into the annular groove 21 that takes place at the ends of the external half-shrouds. Yet, using one annular external shroud instead of two external half-shrouds is advantageous, because the step of assembling two half-shrouds is avoided.

GENERAL DESCRIPTION OF THE INVENTION

The subject matter of the invention offers a solution to the drawback that has been described, by proposing a system making it possible to use annular external shrouds.

According to a first aspect, the invention thus essentially relates to an aircraft engine annular shroud comprising:

- on its internal surface, a peripheral annular groove able to accept a plurality of blade roots;
- an insertion opening for inserting blade roots into the annular groove;
- closure means for closing off the insertion opening.

The annular shroud according to the invention having an annular groove and an insertion opening, it replaces the assembly comprising two half-shrouds of the prior art.

Apart from the main characteristics that have been mentioned in the preceding paragraph, the annular shroud according to the invention may have one or more complementary characteristics among the following, considered individually or in any technical possible combinations thereof:

- the insertion opening is situated on the annular groove;
- the insertion opening does not pass through the annular shroud and it comprises two notches situated on either side of the annular groove;
- the closure means comprise:
  - a lock blade, said lock blade comprising a projecting part able to pass through an opening formed in the insertion opening;
  - maintaining means able to fix themselves on the projecting part of the lock blade.
- the projecting part is formed by a screw, and the maintaining means are formed by a nut;
- the insertion opening is an opening passing through a wall of the annular shroud;
- the closure means comprise:
  - a cover able to cover the insertion opening;
  - maintaining means able to maintain the cover on the insertion opening.

According to a second aspect, the invention relates to a downstream guide vane comprising an annular shroud according to the invention.

According to a third aspect, the invention relates to a method of mounting blades on an annular shroud, said annular shroud comprising:

- on its internal surface, a peripheral annular groove able to accept a plurality of blade roots;
- an insertion opening intended for inserting blade roots into the annular groove;
- closure means for closing off the insertion opening;

said method comprising the following steps:

- introduction of a blade root into the insertion opening;
- sliding of the blade root in the annular groove;
- closure of the insertion opening.

Apart from the main characteristics that have been mentioned in the preceding paragraph, the method of mounting blades on an annular shroud according to the invention may have the following complementary characteristic:

the method is carried out by means of the insertion opening, said insertion opening coming in the form:

either of two notches situated on either side of the annular groove;

or of an opening passing through a wall of the annular shroud.

The invention and its different applications will be better understood on reading the description that follows and by examining the figures that accompany it.

BRIEF DESCRIPTION OF DRAWINGS

The figures are presented by way of indication and in no way limit the invention.

The figures show.

DETAILED DESCRIPTION OF AT LEAST ONE EMBODIMENT OF THE INVENTION

Figure 1:
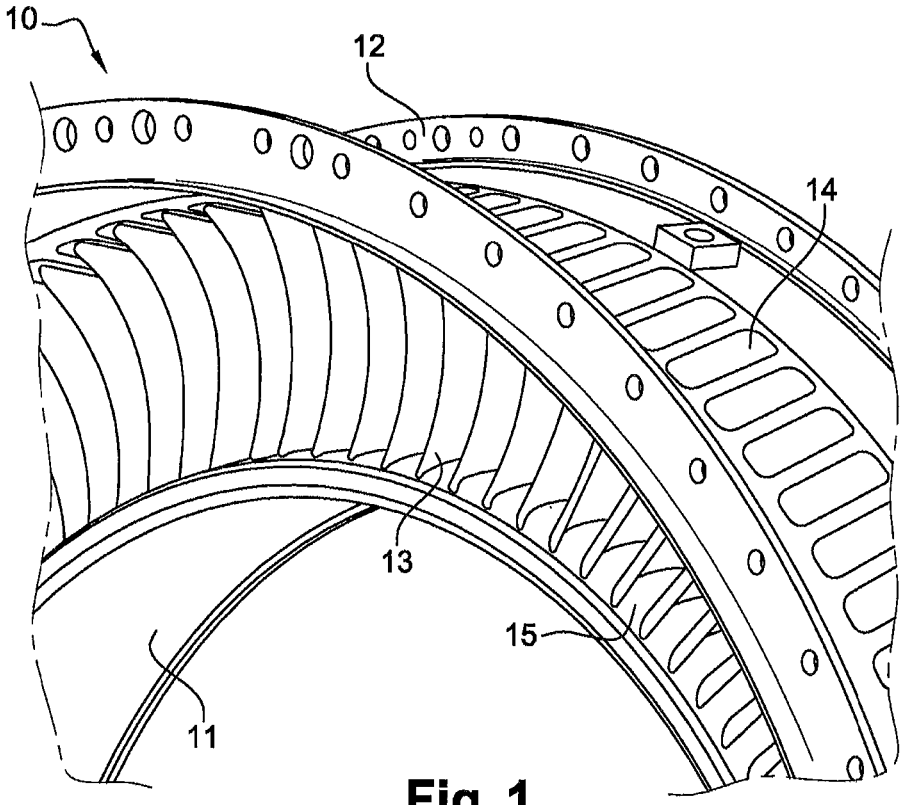
in FIG. 1, already described, a three-dimensional view of a section of a downstream guide vane according to a first embodiment of the prior art.
Figure 2:
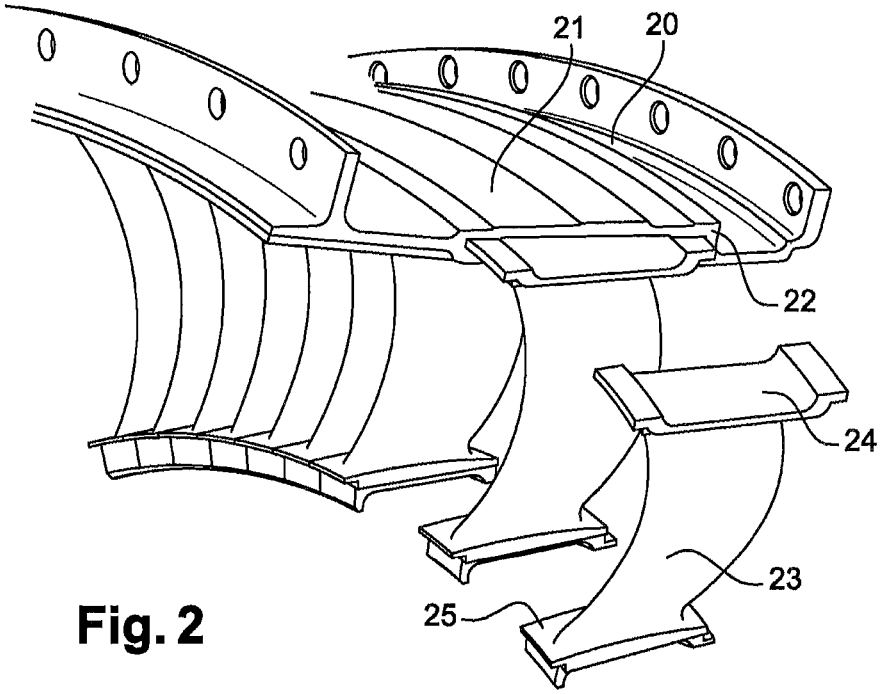
in FIG. 2, already described, a semi-exploded view of a part of a downstream guide vane according to a second embodiment of the prior art.
Figure 3:
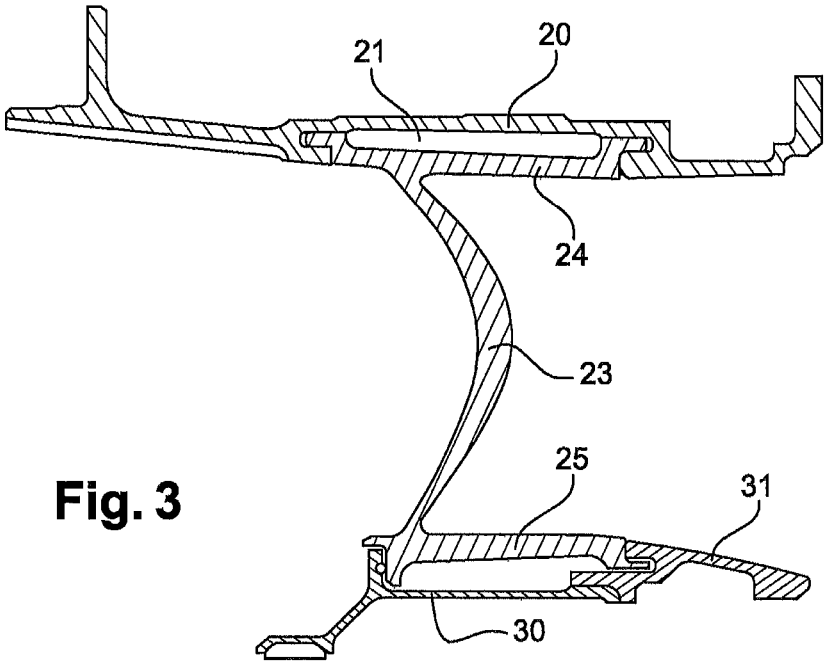
in FIG. 3, already described, a sectional view of the downstream guide vane of FIG. 2.
Figure 4:
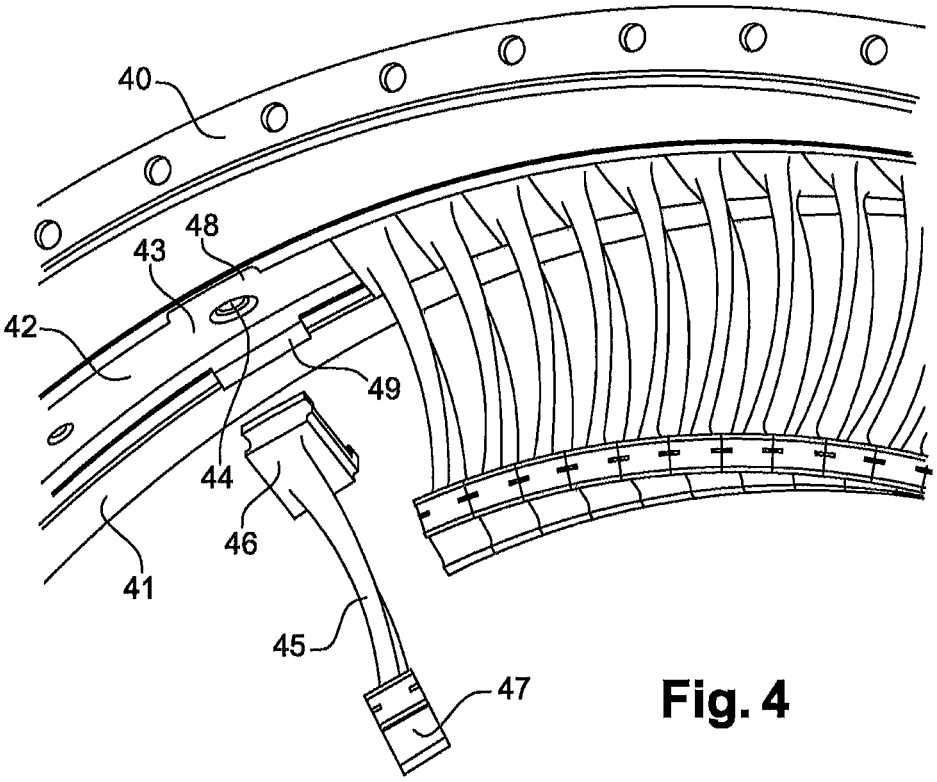
in FIG. 4, a first schematic representation of a section of an annular shroud according to a first embodiment of the invention.
Figure 5:
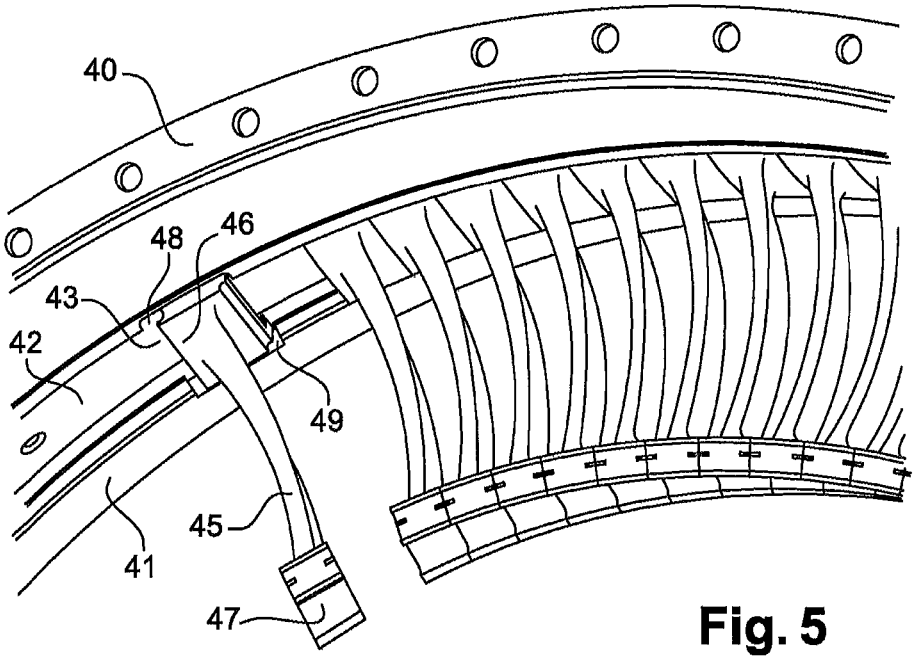
in FIG. 5, a second schematic representation of a section of the annular shroud of FIG. 4.
Figure 6:
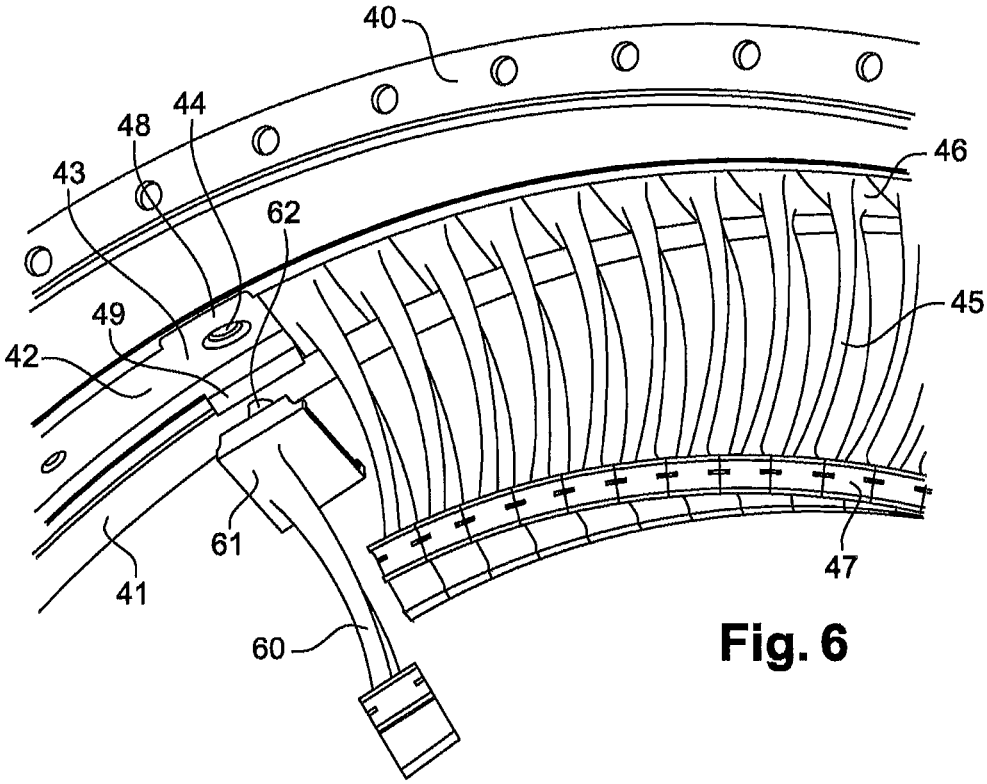
in FIG. 6, a third schematic representation of a section of the annular shroud of FIG. 4.
Figure 7:
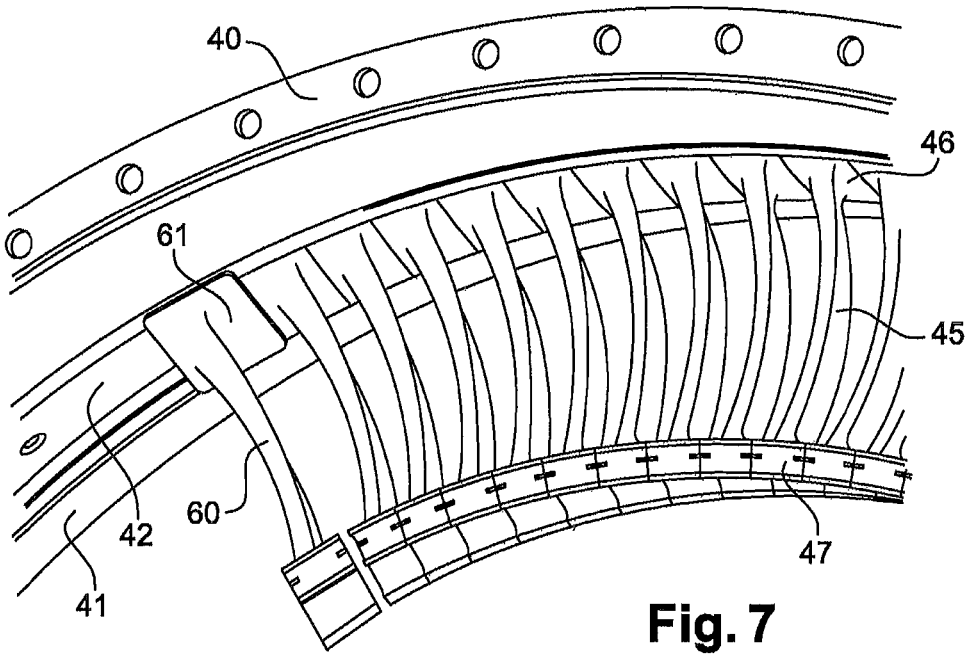
in FIG. 7, a fourth schematic representation of a section of the annular shroud of FIG. 4.
Figure 8:
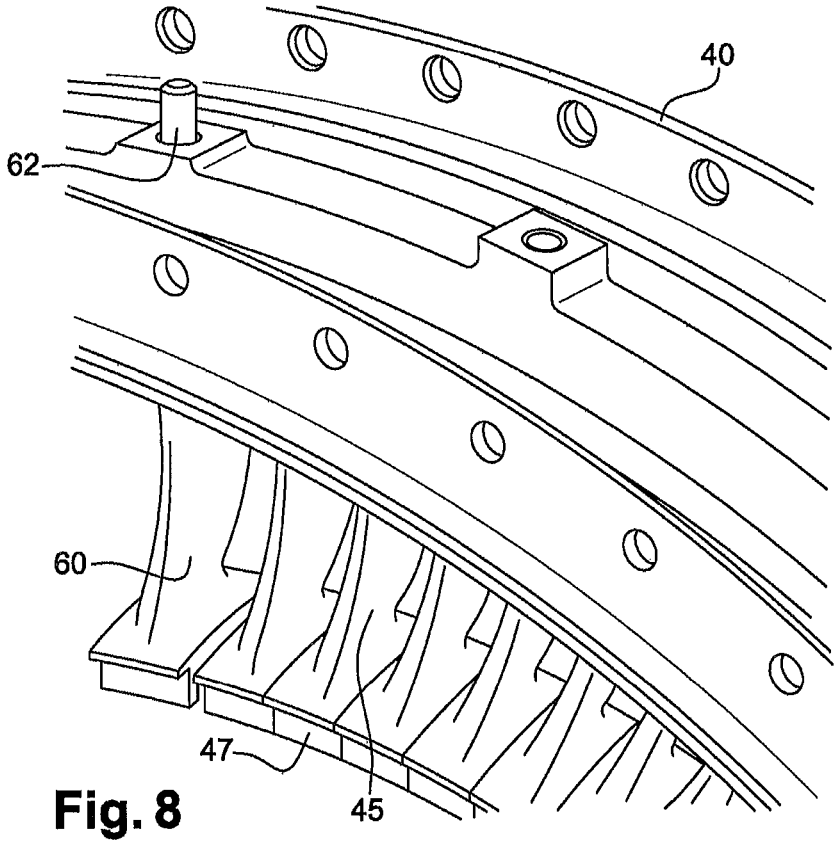
in FIG. 8, a fifth schematic representation of a section of the annular shroud of FIG. 4.

FIGS. 4 and 8 are schematic representations of a section of an annular shroud 40 according to a first embodiment of the invention, said annular shroud 40 comprising:

an internal surface 41;

a peripheral annular groove 42;

an insertion opening 43;

an opening 44;

The annular shroud 40 is able to cooperate with a plurality of blades 45, and with a lock blade 60 represented in FIGS. 6 to 8. Each blade 45 comprises an external root 46 and an internal root 47. The annular groove 42 is positioned on the internal surface 41 of the shroud 40, and is able to accept the external roots 46 of the blades 45. The insertion opening 43 is positioned on the annular groove 42 and comprises two notches 48 and 49 situated on either side of the annular groove 42. The insertion opening 43 is intended for inserting the external roots 46 of the blades 45 into the annular groove 42. In fact, each external root 46 is inserted into the insertion opening 43, as represented in FIG. 5, then slid in the annular groove 42 to be maintained there. To this end, the annular groove 42 has a complementary shape to that of the external roots 46 of the blades 45, such that each external root 46 is maintained in the annular groove 42 by simple shape cooperation.

Furthermore, the opening 44 is formed in the centre of the insertion opening 43, and passes through the shroud 40. In addition, the lock blade 60 comprises an external root 61 surmounted by a projecting part 62, said projecting part 62 being able to be inserted into the opening 44, as represented in FIG. 8. The size of the external root 61 of the lock blade 60 is equal to the size of the insertion opening 43. Thus, when the lock blade 60 is inserted into the insertion window, the projecting part 62 is inserted into the opening 44, and the blades 45 are maintained blocked in the annular groove 42, as represented in FIG. 7.

Figure 9:
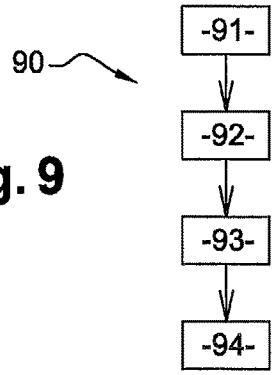
in FIG. 9, a synoptic of the steps of a method of assembling blades on the annular shroud of FIGS. 4 to 8, according to an example of implementation of the method according to the invention.
Figure 10:
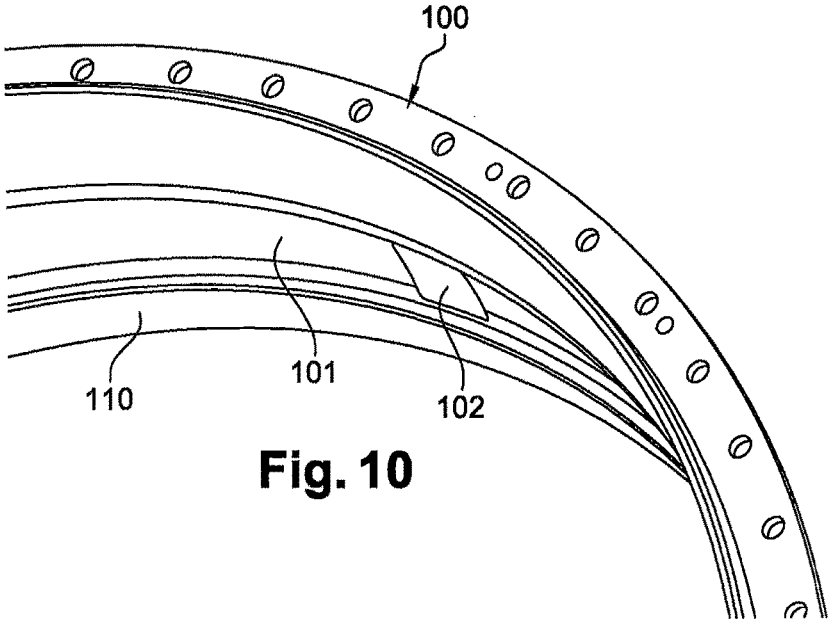
in FIG. 10, a schematic representation of a section of an annular shroud according to a second embodiment of the invention.
Figure 11:
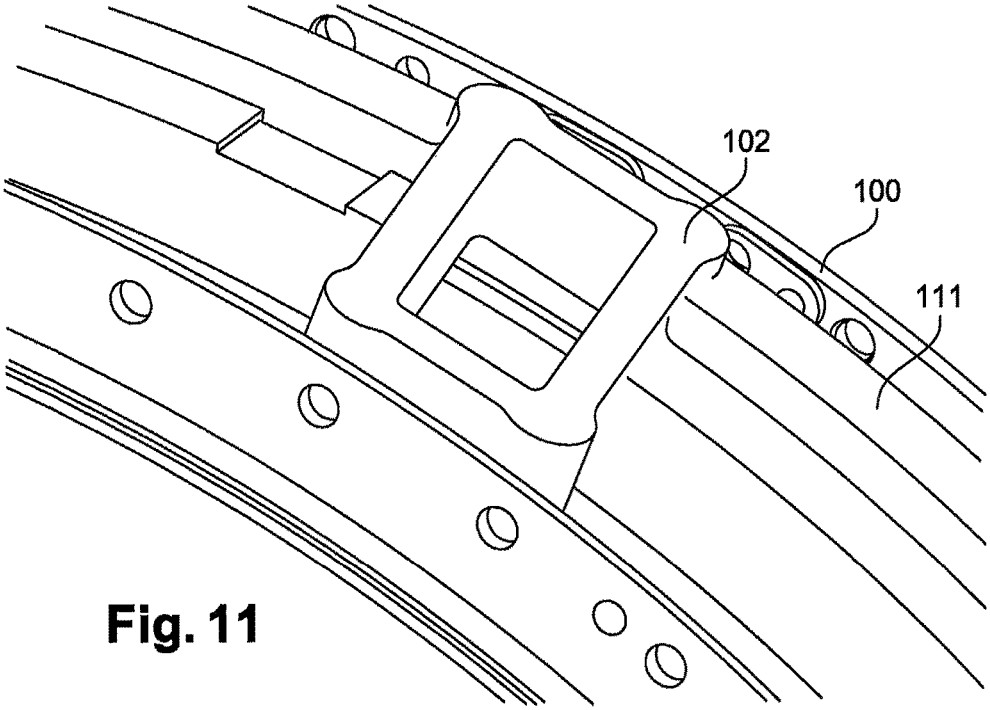
in FIG. 11, a second schematic representation of a section of the annular shroud of FIG. 10.

Moreover, as represented in FIG. 9, the assembly of the blades 45 and the lock blade 60 on the annular shroud 40 according to the first embodiment of the invention is carried out according to a method 90 comprising the following steps:

a first step 91 of inserting an external root 46 of a blade 45 into the insertion opening 43. The first step 91 is represented in FIG. 5.

a second step 92 of sliding in the annular groove 42 the external root 46, so as to free the insertion opening 43;

the first step 91 and the second step 92 being reiterated a number of times equal to the number of external roots 46 of blades 45 to be positioned in the annular groove 42;

a third step 93 of inserting the external root 61 of the lock blade 60 into the loading opening 43. The projecting part 62 is also inserted into the opening 44. The third step 93 is represented in FIGS. 7 and 8.

a fourth step 94 of fixing the external root 61 of the lock blade 60 via fixation means, not represented, for example a nut able to screw onto the projecting part 62.

Figure 12:
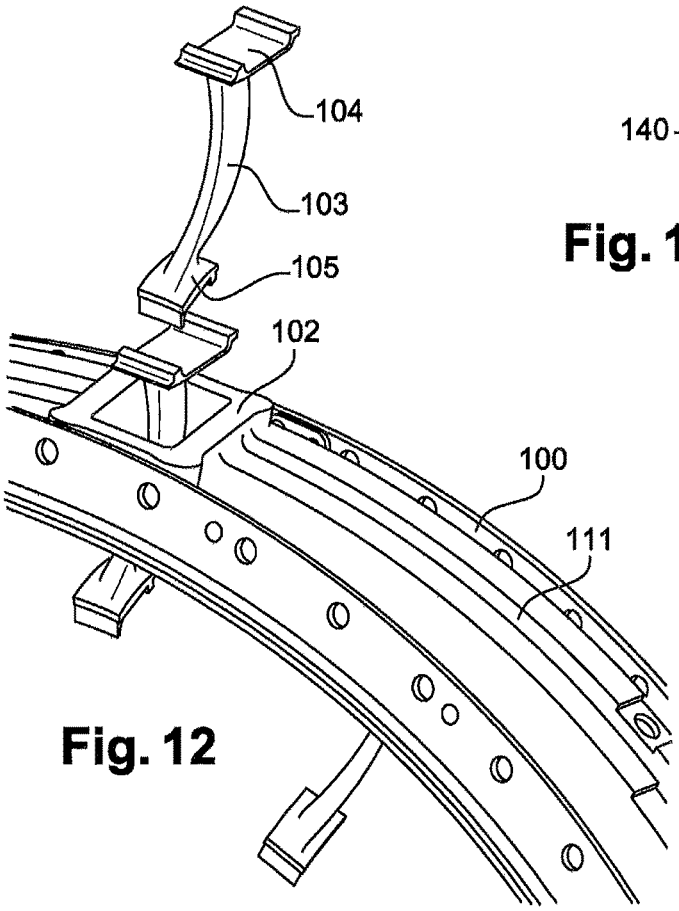
in FIG. 12, a third schematic representation of a section of the annular shroud of FIG. 10.
Figure 13:
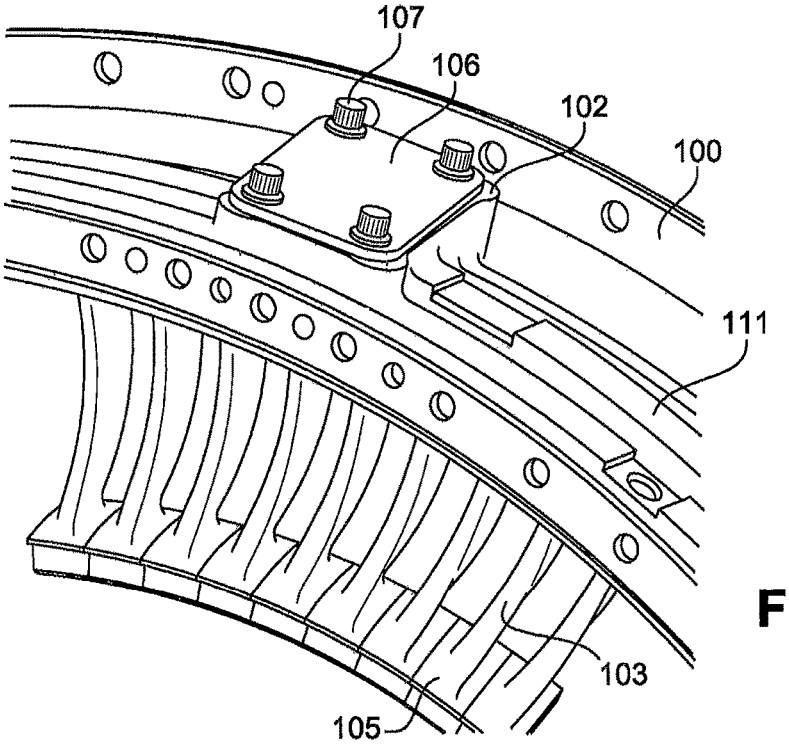
in FIG. 13, a fourth schematic representation of a section of the annular shroud of FIG. 10.

FIGS. 10 to 13 are schematic representations of a section of an annular shroud 100 according to a second embodiment of the invention. The annular shroud 100 comprises:

an internal surface 110;

an external surface 111;

a peripheral annular groove 101;

an insertion opening 102;

The annular shroud 100 is able to cooperate with a plurality of blades 103. Each blade 103 comprises an external root 104 and an internal root 105. The annular groove 101 is positioned on the internal surface 110 of the shroud 100, and is able to accept the external roots 104 of the blades 103. The insertion opening 102 is an opening formed on the annular shroud 100 and passing through the wall of the annular shroud 100. The insertion opening 102 is intended for inserting the external roots 104 of the blades 103 into the annular groove 101. In fact, each blade 103 is inserted into the insertion opening 102 on the side of the external wall 111, as represented in FIG. 12, then the external root 104 of the blade 103 is slid into the annular groove 102 to be maintained there. In FIG. 13, a cover 106 closes the insertion opening 102, preventing the insertion of new blades and preventing the blades 103 from disengaging from the annular groove 103. The cover 106 is fixed to the insertion opening 102 via screws 107. The blades 103 are then maintained blocked in the annular groove 101.

Figure 14:
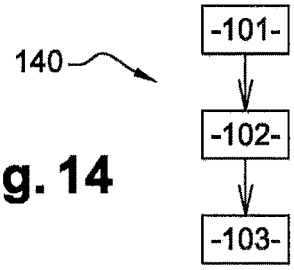
in FIG. 14, a synoptic of the steps of a method of assembling blades on the annular shroud of FIGS. 10 to 13, according to an example of implementation of the method according to the invention.

Moreover, as represented in FIG. 14, the assembly of the blades 103 and on the annular shroud 100 according to the second embodiment of the invention, is carried out according to a method 140 comprising the following steps:

a first step 101 of insertion of a blade 103 into the insertion opening 102. The first step 101 is represented in FIG. 12.

a second step 102 of sliding in the annular groove 102 the external root 104, so as to free the insertion opening 102;

the first step 101 and the second step 102 being reiterated a number of times equal to the number of external roots 104 of blades 103 to be positioned in the annular groove 102;

a third step 103 of fixing the cover 106 on the insertion opening, by means of screws 107.

The invention claimed is:

1. An aircraft engine annular shroud, comprising:

on its internal surface, a peripheral annular groove able to accept a plurality of blade roots;

an insertion opening for inserting the blade roots into the annular groove;

a closure device constructed and arranged to close off the insertion opening, wherein the closure device comprises:

a lock blade, said lock blade comprising a projecting part able to pass through an opening formed in the insertion opening, and a fastener able to be fixed on the projecting part of the lock blade.

2. The annular shroud according to claim 1, wherein the insertion opening is arranged on the annular groove.

3. The annular shroud according to claim 1, wherein the insertion opening does not pass through the annular shroud and wherein the annular shroud further comprises two notches arranged on either side of the annular groove.

4. The annular shroud according to claim 1, wherein the projecting part is formed by a screw, and wherein the fastener is formed by a nut.

5. An aircraft engine downstream guide vane comprising an annular shroud according to claim 1.

6. A method of mounting blades on an aircraft engine annular shroud according to claim 1, said method comprising:

inserting a blade into the insertion opening;

sliding of the blade root in the annular groove;

closing the insertion opening.

7. The method of mounting blades on an aircraft engine annular shroud according to claim 6, wherein the insertion opening is in the form:

of two notches arranged on either side of the annular groove.

8. An aircraft engine annular shroud comprising:

an external and an internal surface;

a peripheral annular groove formed in the internal surface and configured to receive a plurality of blade roots;

an aperture formed in the peripheral annular groove and extending through the annular shroud so that said aperture has a first opening formed on the external surface and a second opening formed in the internal surface, the second opening having a lateral dimension larger than a lateral dimension of the annular groove so that blade roots are slidable into the annular groove after being received in the aperture;

a cover configured to close the aperture, and a fastener constructed and arranged to maintain the cover on the aperture.

9. An aircraft engine annular shroud comprising:

an external and an internal surface;

a peripheral annular groove formed in the internal surface and configured to receive a plurality of blade roots;

an aperture formed in the peripheral annular groove and extending through the annular shroud so that said aperture has a first opening formed on the external surface and a second opening formed on the internal surface, the aperture configured to receive the blade roots so that the blade roots are slidable into the annular groove after being received in the aperture;

a cover configured to close the aperture, and a fastener constructed and arranged to maintain the cover on the aperture.

10. The annular shroud according to claim 9, wherein the fastener includes a plurality of fastening elements, which are screws.

11. An aircraft engine downstream guide vane comprising an annular shroud according to claim 9.

12. A method of mounting blades on an aircraft engine annular shroud according to claim 9, said method comprising:

inserting a blade into the aperture;

sliding of the blade root in the annular groove;

closing the aperture with the cover.

* * * * *